US008156819B2

(12) United States Patent
Koller et al.

(10) Patent No.: US 8,156,819 B2
(45) Date of Patent: Apr. 17, 2012

(54) METHOD FOR CHECKING A KNOCKING DEVICE

(75) Inventors: Felix Koller, Schinznach-Dorf (CH); Erich Vogler, Hedingen (CH)

(73) Assignee: Von Roll Umwelttechnik AG, Zurich (CH)

( * ) Notice: Subject to any disclaimer, the term of this patent is extended or adjusted under 35 U.S.C. 154(b) by 233 days.

(21) Appl. No.: 12/464,757

(22) Filed: May 12, 2009

(65) Prior Publication Data

US 2010/0116018 A1 May 13, 2010

(30) Foreign Application Priority Data

May 13, 2008 (EP) ..... 08008811

(51) Int. Cl.
*G01N 3/00* (2006.01)

(52) U.S. Cl. ..... 73/760

(58) Field of Classification Search ..... 73/760; 122/379

See application file for complete search history.

(56) References Cited

U.S. PATENT DOCUMENTS 4,018,267 A * 4/1977 Tomasicchio ..... 165/84
4,595,048 A * 6/1986 Pollak et al. ..... 165/84
4,893,588 A 1/1990 Jekerle et al.
5,315,966 A * 5/1994 Gamache et al. ..... 122/379
5,540,275 A * 7/1996 Eisinger ..... 165/84
5,873,408 A * 2/1999 Bellet et al. ..... 165/84
6,308,774 B1 * 10/2001 Kramer et al. ..... 165/95
7,823,627 B2 * 11/2010 Yeganeh et al. ..... 165/95
2007/0267175 A1 11/2007 Yegneh et al.

FOREIGN PATENT DOCUMENTS

DE 38 36 707 5/1989
GB 2 147 078 5/1985
JP 59 069697 4/1984

OTHER PUBLICATIONS

European Search Report dated Oct. 20, 2008 for EP 08 00 8811.5.
English Language Abstract/Bibliography for JP 59 069697.

* cited by examiner

*Primary Examiner* — Lisa Caputo
*Assistant Examiner* — Octavia Davis

(57) ABSTRACT

A method is provided for checking a knocking device which is intended for cleaning a surface of a heat exchanger element arranged on an inside of a boiler housing of a garbage incineration plant. The knocking device has a knocking ram guided through a wall of the boiler housing and movable in a direction toward the inside of the boiler. The heat exchanger element is deflected out of its position of rest into a deflection position by the knocking ram, and the force required for deflecting the heat exchanger element and/or the attenuation behavior of the heat exchanger element released after deflection are/is determined.

11 Claims, 8 Drawing Sheets

METHOD FOR CHECKING A KNOCKING DEVICE

CROSS-REFERENCE TO RELATED APPLICATIONS

This application claims priority under 35 U.S.C. 119 to European Application No. EP 08 008 811.5, filed on May 13, 2008.

BACKGROUND OF THE INVENTION

The present invention relates to a method for checking a knocking device according to the present invention, and to a device for carrying out the method.

Conventional garbage incineration plants have, as a rule, at least one boiler which generates steam or hot water which can be used for generating electrical current or for heating households. Depending on whether steam or hot water is primarily generated in the boiler, this is also designated as a steam generator or as a hot water generator.

Steam or hot water generation takes place by means of heat exchanger elements which are arranged inside the boiler housing. Said heat exchanger elements are present in the convection flues, as they are known, as a rule in the form of tube bundles (also designated as "harps"), the tubes of which have water or steam flowing through them and issue into a header. At these tube bundles, heat is transferred from the hot smoke gas to the water or steam which is thereby heated, evaporated or superheated. Heat transmission takes place primarily by convection in such tube bundles.

However, the surface of these heat exchanger elements is heavily contaminated by the deposition of fly ash entrained in the smoke gas. This contamination or slagging reduces the transfer of heat to the water or steam and therefore leads, overall, to reduced efficiency of the boiler.

Moreover, since the smoke gas cross section is narrowed as a result of the deposits, the pressure loss increases and may lead to the complete clogging of the smoke gas cross section. Further, the maintenance measures required as a result entail high costs and losses of output.

Overall, the contamination or slagging of the heat exchanger elements therefore reduces the "running time" of the boiler (that is to say, the time in which the boiler can operate under the highest safeguarded load, while maintaining all the safeguarded properties, without maintenance being necessary) and, consequently, also the availability of the garbage incineration plant (that is to say, the ratio of the operating time of the plant plus the reserve time to the nominal operating time).

This problem is dealt with, in practice, by cleaning off the surface of the heat exchanger elements while the boiler is in operation. Methods of various types may be considered for this purpose. For example, the surface of the heat exchanger elements may be cleaned off by means of a soot blower, a water spraying plant, a shot peening plant or a knocking device.

In the case of horizontal boiler flues of a garbage incineration plant, the heat exchanger elements are designed, as a rule, as suspendedly arranged tube bundles. For cleaning of such suspended tube bundles, in particular, knocking devices are highly appropriate. In this case, the contaminated tube bundles are set in oscillation by means of a pulse, the incineration residues which adhere to the surface falling off. The pulse is imparted, as a rule, via a knocking ram which, depending on the situation, is actuated by a mechanically driven hammer or by a pneumatic impact cylinder. In general, the impact of the knocking ram takes place on the header of the tube bundle.

Examples of knocking devices are described in the prior art.

Thus, for example, DE 27 10 153 describes the use of an oscillation generator, designed as a knocking device with a knocking cylinder, for cleaning the heating surface of a steam generator.

Further, DE 198 53 715 describes a knocking device for cleaning off tube coils of boiler plants.

The cleaning success of such knocking devices depends in this case on a multiplicity of factors. In addition to the impact energy and the impact frequency, in particular, the oscillation behavior and the suspension of the tube bundles are also of critical importance. Before the boiler of the garbage incineration plant is commissioned, therefore, a check is made, in practice, as to whether the knocking rams of the knocking device impinge onto the location desired in each case and set the tube bundles in oscillation in the desired way.

However, the conditions before the commissioning of the boiler differ very sharply from those during operation, particularly with regard to the operating temperature and the degree of contamination. This, in practice, presents the problem that, even when a check is conducted before commissioning, the operating capacity of the knocking device, that is to say the application of the desired pulse to the heat exchanger element, is often not ensured in full during operation. There is a multiplicity of possible reasons for this. For example, the lack of operating capacity may be due to the fact that the knocking ram is severely warn or is subjected to high friction in the guide through the wall of the boiler housing. Further, it is conceivable, for example, that the heat exchanger element may become jammed during operation and is therefore no longer in its position of rest before commissioning, with the result that an optimal impingement of the knocking ram on the heat exchanger elements is impaired, etc.

No suitable methods have been described hitherto for checking the knocking device while the boiler is in operation. However, it is precisely a check of the knocking device during operation which would be very useful, since only reliable information of this kind makes it possible to ascertain how far the operating capacity of the knocking device is impaired during operation and exactly where maintenance work would have to be carried out.

SUMMARY OF THE INVENTION

The object on which the present invention is based, therefore, is to make available a simple method for checking a knocking device while the boiler is in operation.

The object is achieved, according to the invention, by means of the method according to claim 1. Preferred embodiments are listed in the dependent claims.

According to the method of the present invention, the heat exchanger element is deflected out of its position of rest into a deflection position by means of the knocking ram. In this case, A) the force required for deflecting the heat exchanger element is determined, as a rule as a function of the travel of the latter.

After the heat exchanger element has been released when the deflection position is reached, alternatively or additionally to the determination according to A, B) the attenuation behavior of the heat exchanger element is determined, that is to say the travel of the heat exchanger element as a function of the time.

The determination according to A), that is to say the force required for deflecting the heat exchanger element, delivers, for example, information relating to the arrangement of two or more heat exchanger elements with respect to one another, for example whether the heat exchanger element butts onto one or more further heat exchanger elements during deflection, and at what distance these are from one another in the position of rest. Further, force measurement makes it possible to draw conclusions as to the frictional resistance of the knocking ram guided through the housing wall or as to the wear of said knocking ram.

Via the determination according to B), it is possible, for example, to ascertain whether, during the deflection or attenuation of the heat exchanger element, a jamming of the latter occurs. On the other hand, the damping constant determined via the attenuation behavior makes it possible to draw conclusions as to the mass of the contaminated heat exchanger element and therefore as to the degree of contamination of the latter.

The evaluation of the data obtained according to the invention may take place via differentiation with respect to reference data determined before the commissioning of the boiler.

According to a preferred embodiment, both the force required for deflecting the heat exchanger element, according to A), and the attenuation behavior of the heat exchanger element, according to B), are determined.

Moreover, it is preferable that the force required for deflecting the heat exchanger element is determined by means of a force sensor.

How the movement of the knocking ram in the direction for deflecting the heat exchanger element is to take place is known to a person skilled in the art. It is conceivable, for example, that the knocking ram is pushed by means of a pushing piston of a pneumatic lifting cylinder. In such an embodiment, alternatively or additionally to the force sensor, a pressure sensor may be provided which detects the pressure acting upon the pushing piston.

As a rule, in said embodiment, the lifting cylinder has, moreover, switches which are intended to be actuated when a predetermined force or a predetermined pressure is reached, to the effect that the lifting cylinder is vented and therefore relieved in the shortest possible time.

According to a particularly preferred embodiment of the method according to the invention, the movement of the knocking ram is detected in order to determine the attenuation behavior of the heat exchanger element. In this case, the knocking ram is generally held in continuous bearing contact with the heat exchanger element, in particular by means of a spring. The latter is generally designed in the form of a compression spring arranged on the knocking ram.

Preferably, the attenuation behavior of the heat exchanger element is determined by means of a travel sensor. It is conceivable, for example, that the travel sensor comprises an optical sensor, for example a laser rangefinder. In this case, the travel sensor is arranged, as a rule, at a predetermined distance from the wall of the boiler housing and detects the movement of the knocking ram directly or via a reflection element arranged on the knocking ram. However, any other type of travel sensor which is known to a person skilled in the art and is suitable for the corresponding purposes may also be envisaged.

Moreover, the force sensor or the travel sensor is generally assigned a data recorder in which the data obtained are recorded. The data, coming from the data recorder, may be fed into a computer for graphical representation or other evaluation.

BRIEF DESCRIPTION OF THE DRAWINGS

The invention is explained further with reference to the figures, in which.

DETAILED DESCRIPTION OF THE INVENTION

Figure 1:
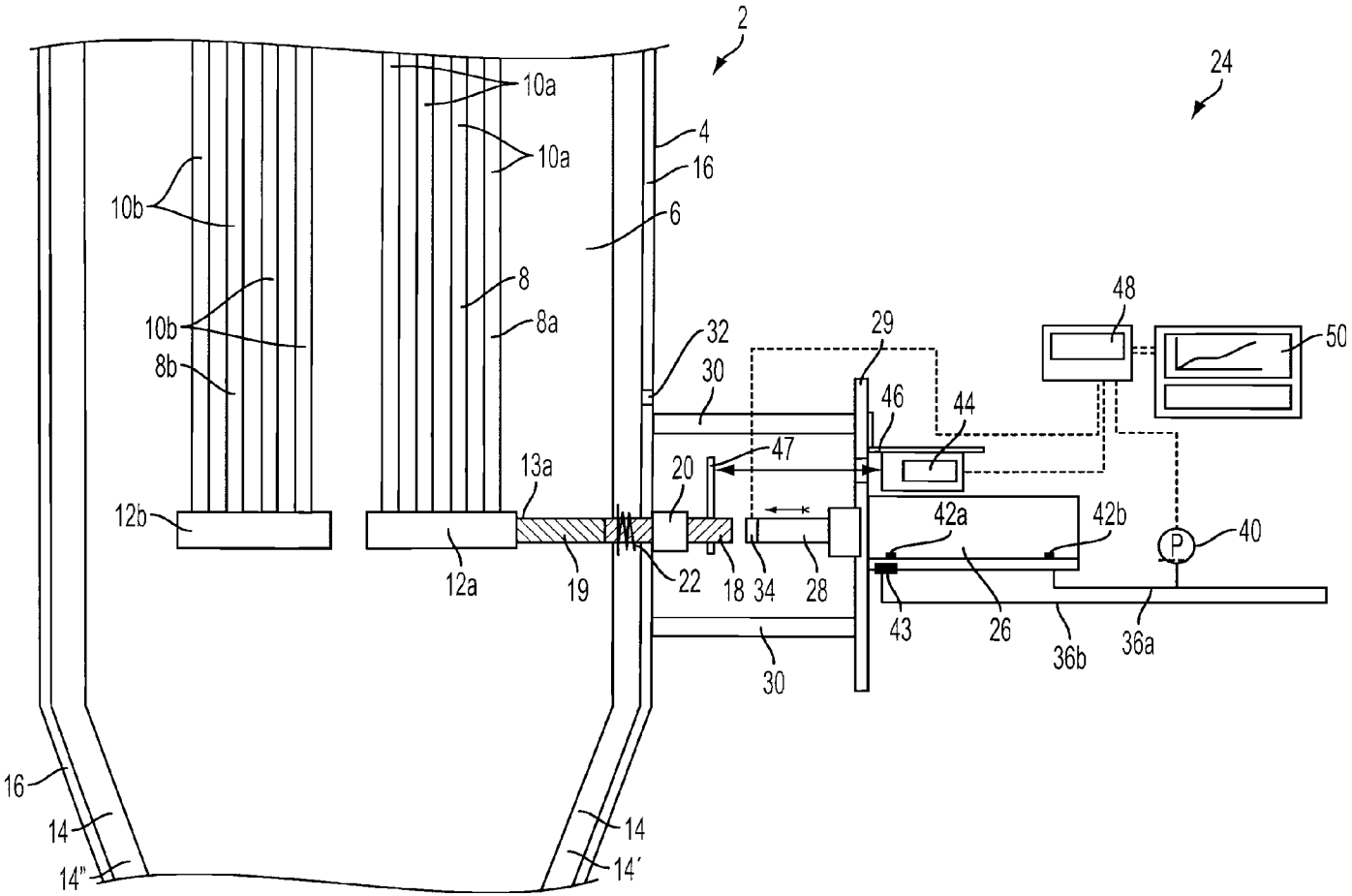
FIG. 1 shows, purely diagrammatically, part of a boiler housing with two heat exchanger elements arranged inside it, and a device according to the invention, arranged outside the boiler housing, for checking a knocking device acting on the heat exchanger element.

According to FIG. 1, the boiler 2 of the garbage incineration plant has a boiler housing 4, in the inside 6 of which are arranged, suspended, heat exchanger elements 8 in the form of tube bundles 8*a*, 8*b*, the tubes 10*a*, 10*b* of which issue at their lower end region lying opposite the suspension into a header tube 12*a* or 12*b* (also designated as a "header") having an essentially horizontal longitudinal axis. The diagrammatic illustration according to FIG. 1 shows two tube bundles 8*a*, 8*b* which are arranged in series and which in each case comprise four tubes 10*a* and 10*b* issuing into the headers 12*a* and 12*b*. However, any other number, suitable for the corresponding purposes, of tube bundles and of tubes which these comprise may also be envisaged.

The wall 14 of the boiler housing 4 has on its side facing away from the inside 6 a jacket 16 consisting of thermally insulating material. A knocking ram 18 is guided through the wall 14 of the boiler housing 4, is mounted in a sleeve 20 arranged outside the boiler housing 4 and can be moved in the direction toward the inside 6, in the diagrammatic illustration according to FIG. 1 the longitudinal axis and the direction of movement of the knocking ram 18 being essentially at right angles to the wall 14 of the boiler housing 4.

The end-face region of the knocking ram 18 forms what is known as the arrow point 19. This is in bearing contact with the header 12*a* of a first tube bundle 8*a* of the two tube bundles 8*a*, 8*b*. In this case, the knocking ram 18 is assigned a spring 22 which ensures that the arrow point 19 is pressed against the baffle plate 13*a* of the header 12*a*.

A device 24 according to the present invention is arranged outside the boiler housing 4. Said device has a drive in the form of a lifting cylinder 26 and a pushing piston 28 movable in the direction of the knocking ram 18 by means of the lifting cylinder 26.

The lifting cylinder 26 is connected to the boiler housing 4 via a carrier plate 29 with spacers 30 which are arranged on it and which, moreover, on their side facing away from the carrier plate 29 are mounted on a connecting plate 32 arranged on the wall 14 of the boiler housing 4.

The pushing piston 28 is oriented such that its longitudinal axis defining the pushing direction coincides with the longitudinal axis of the knocking ram 18. Moreover, the pushing piston 28 has a force sensor 34 for the continuous determination of the force exerted on the knocking ram 18.

The lifting cylinder 26 shown in FIG. 1 is operated pneumatically and, for this purpose, has a compressed-air supply line 36*a* for the forward movement of the pushing piston 28 and a compressed-air return line 36*b* for the backward movement of the pushing piston 28. The forward and the backward movements of the pushing piston 28 are in this case controlled via a valve. The compressed-air supply line 36*a* is assigned, further, a pressure sensor 40 for determining the pressure acting upon the pushing piston 28.

Moreover, the lifting cylinder 26 has sensors 42*a*, 42*b* for determining the position of the pushing piston 28. The sensors 42*a*, 42*b* are assigned a switch which is actuated when a predetermined position of the pushing piston 28 is reached, to the effect that the lifting cylinder 26 is vented and the pushing piston 28 is moved back. Alternatively or additionally to this, a switch 43 may be provided which, when a predetermined pressure or a predetermined force is reached, is actuated in order to vent the lifting cylinder 26 or to move back the pushing piston 28.

Furthermore, the device 24 has a travel sensor 44. This is connected via a connecting element 46 to the carrier plate 29 and is therefore arranged at a constant distance from the boiler housing 4. The travel sensor 44 is in communication with a sheet-like reflection element 47 which is arranged in a region, lying outside the boiler housing 4, of the knocking ram 18 and the plane of which is essentially at right angles to the longitudinal axis of the knocking ram 18 in the illustration shown in FIG. 1.

Both the force sensor 34 and the pressure sensor 40 and the travel sensor 44 are connected to a data recorder 48, via which the data are fed into a computer 50 in which they can be evaluated.

According to the illustration shown in FIG. 1, the tube bundles 8*a*, 8*b* are in the position of rest. To carry out the method according to the invention, the pushing piston 28 is pushed via the lifting cylinder 26 in the direction of the knocking ram 18 which is consequently moved in the direction toward the inside 6 of the boiler housing 4. The movement of the pushing piston 28 or of the knocking ram 18 takes place in this case at a speed of approximately 10 to 100 mm/second.

As a result of the movement of the knocking ram 18, the first tube bundle 8*a* is deflected. After a certain stroke, the header 12*a* of the first tube bundle 8*a* butts onto the header 12*b* of the second tube bundle 8*b* which is consequently also deflected until it butts against that wall 14" of the boiler housing 4 which lies opposite the wall 14' through which the knocking ram 18 passes.

The force required for deflecting the tube bundle 8*a* or 8*b* into the deflection position as a function of its travel is determined continuously by means of the force sensor 34 assigned to the pushing piston 28.

As soon as the deflection position is reached, the lifting cylinder 26 is immediately relieved or vented and the pushing piston 28 is retracted. The tube bundles 8*a*, 8*b* are thereby released and consequently experience an attenuation of their oscillations. The knocking ram 18 which is in bearing contact with the first tube bundle 8*a* is pushed back by the latter into a swing-back position. The spring 22 assigned to the knocking ram 18 ensures that the latter is held in bearing contact against the first tube bundle 8*a* or its header 12*a* during the entire attenuation process.

It is thus possible to detect the attenuation behavior of the tube bundle 8*a* via the movement of the knocking ram 18. For this purpose, its distance from the reflection element 47 over time is determined by means of the travel sensor 44.

The data obtained are picked up by means of the data recorder 48 and fed for evaluation into the computer 50.

Figure 2:
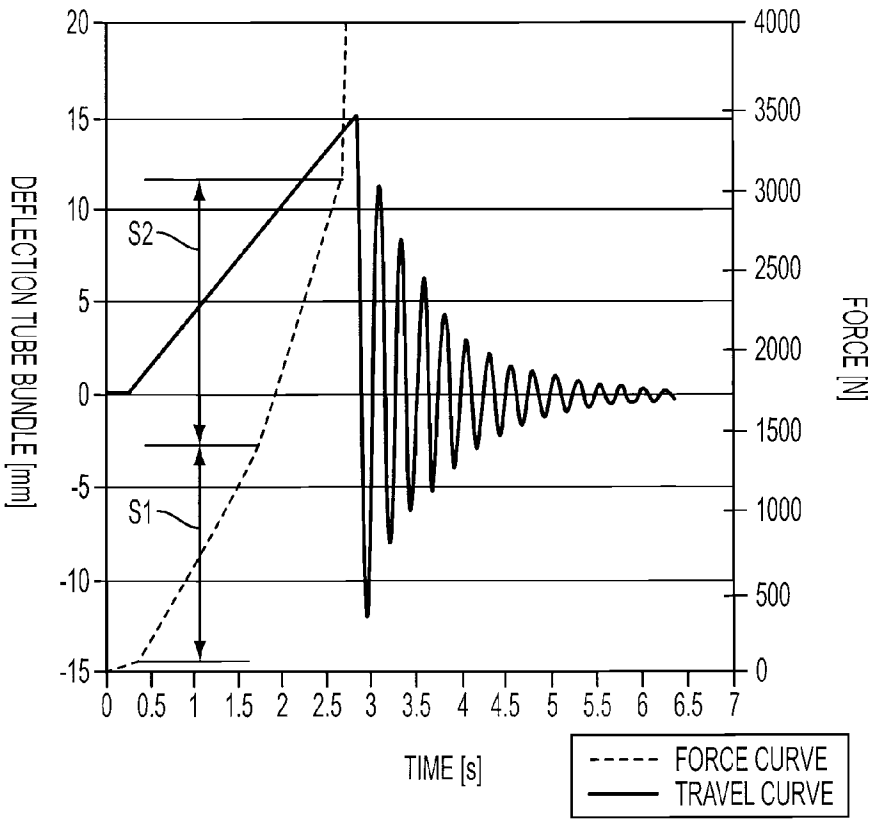
FIG. 2 shows, purely diagrammatically, part of a boiler housing with two heat exchanger elements arranged inside it, and a graphical representation of the data determined by means of the method according to the invention.
Figure 2:
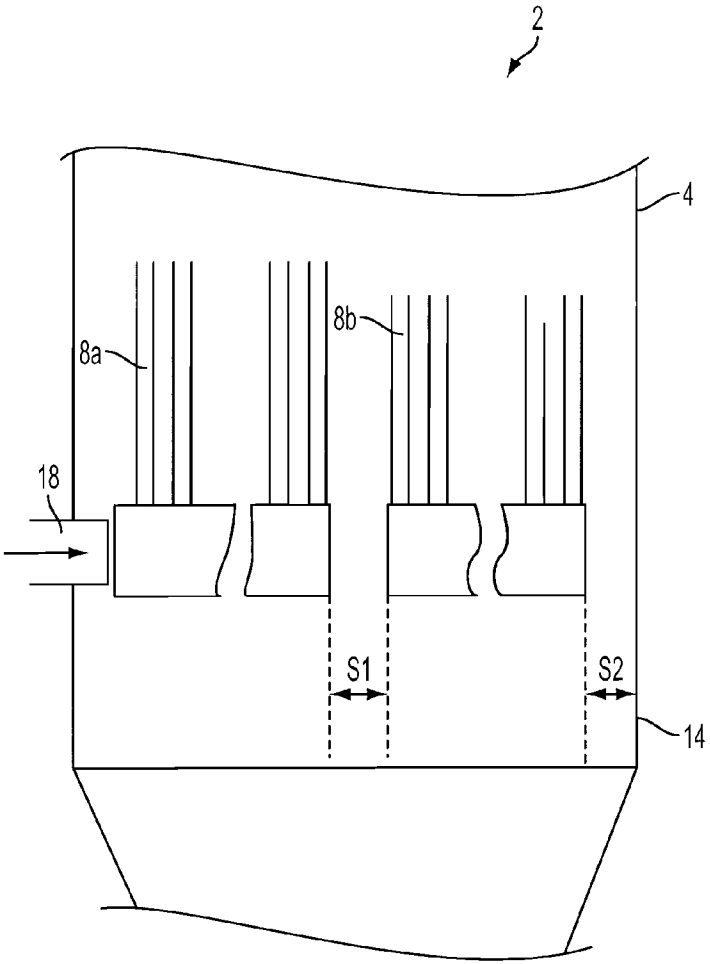

A diagrammatic illustration of the arrangement of two tube bundles 8*a*, 8*b* in a boiler 2, with an idealized graphical illustration of the force required for deflecting the tube bundles 8*a*, 8*b* and of the attenuation behavior of the tube bundle 8*a* in bearing contact with a knocking ram 18, after the release of said tube bundle, is shown in FIG. 2.

As is clear from FIG. 2, the force curve shown by a dashed line has a profile increasing in steps. In this case, the curve segment S1 corresponds to the stroke for deflecting only the first tube bundle 8*a* of the two tube bundles 8*a*, 8*b*. At the point at which the first tube bundle 8*a* butts onto the second tube bundle 8*b*, the force to be applied increases. This point marks the start of the curve segment S2 which corresponds to that stroke in which the second tube bundle 8*b* is also deflected in addition to the first tube bundle 8*a*. The stroke S2 ends at the point at which the second tube bundle 8*b* butts onto the wall 14 of the boiler housing 4. From this point, that is to say the deflection position, as it is known, the force curve rises sharply. Immediately after the detection of the deflection position, the tube bundles 8*a*, 8*b* are released and their attenuation behavior is determined.

The travel curve shown by an unbroken line in FIG. 2 corresponds to the damped oscillation of a pendulum and reflects the situation on the inside 6 of the boiler housing 4, in which the first tube bundle 8*a* and, if appropriate, also the second tube bundle 8*b* can freely attenuate their oscillations without butting onto further elements or being blocked by these. The damping constant can be determined from the oscillation of the tube bundles, thus making it possible to draw conclusions as to the mass of the contaminated tube bundle and therefore as to its degree of contamination.

Figure 3:
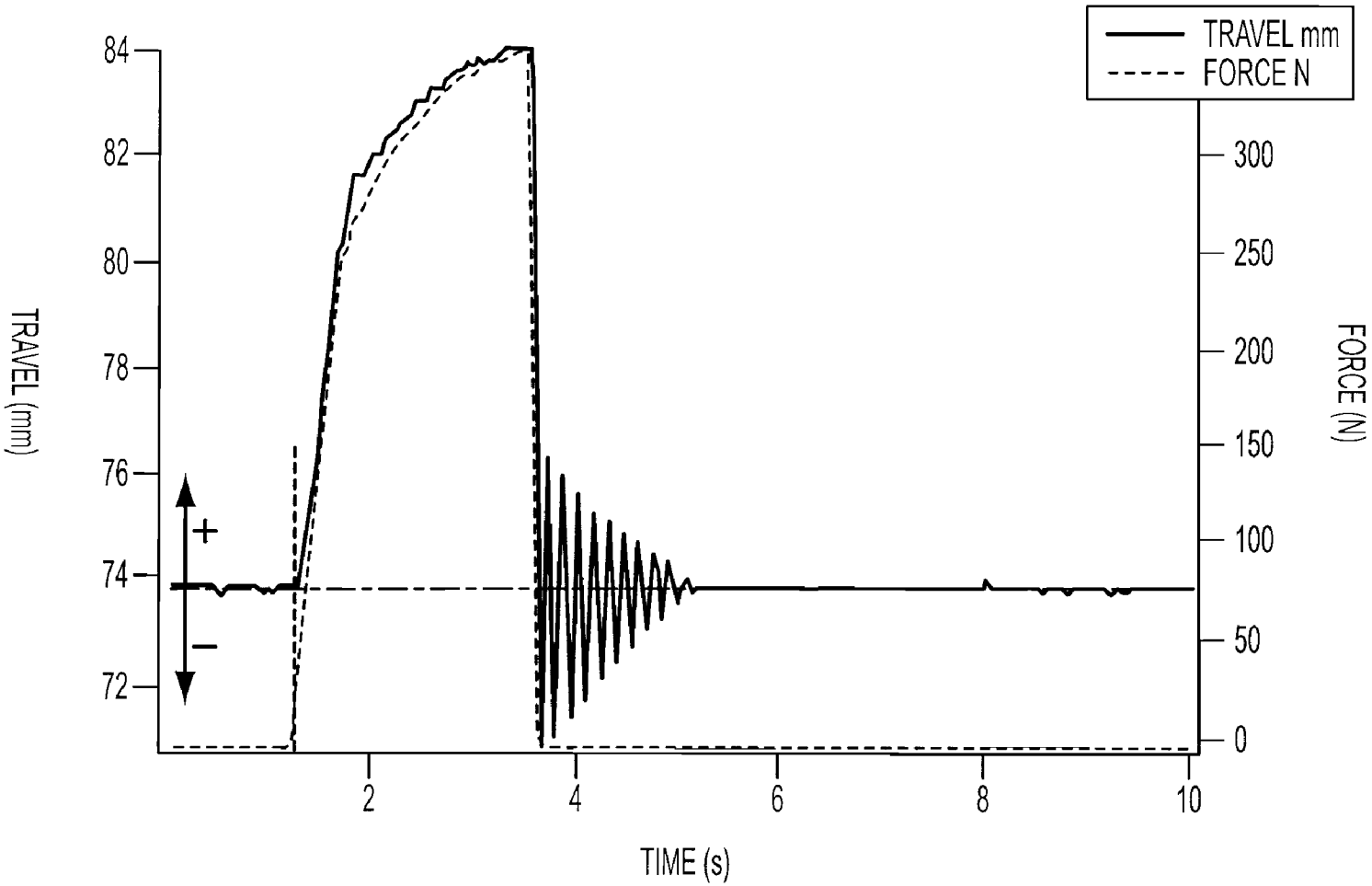
FIGS. 3 to 8 show in each case a graphical representation of data determined by means of the method according to the invention in six different situations.

A graphical illustration of the data determined according to the invention in a further situation is shown in FIG. 3. In this, as also for FIGS. 4 to 8, the force curve determined according to A of claim 1 is illustrated by a dashed line and the travel curve determined according to B of claim 1 is illustrated by an unbroken line.

As is clear from FIG. 3, at the commencement of deflection, the rise of the travel curve and the rise of the force curve are essentially simultaneous, which points to the fact that the knocking ram is subjected to only low friction in the knocking ram guide and at least the heat exchanger element which is in bearing contact against the knocking ram is not jammed. The travel curve shown in FIG. 3 corresponds to a damped oscillation of a pendulum, thus making it possible to draw the conclusion that the heat exchanger element can freely attenuate its oscillations, without butting against further elements or being blocked by these.

Figure 4:
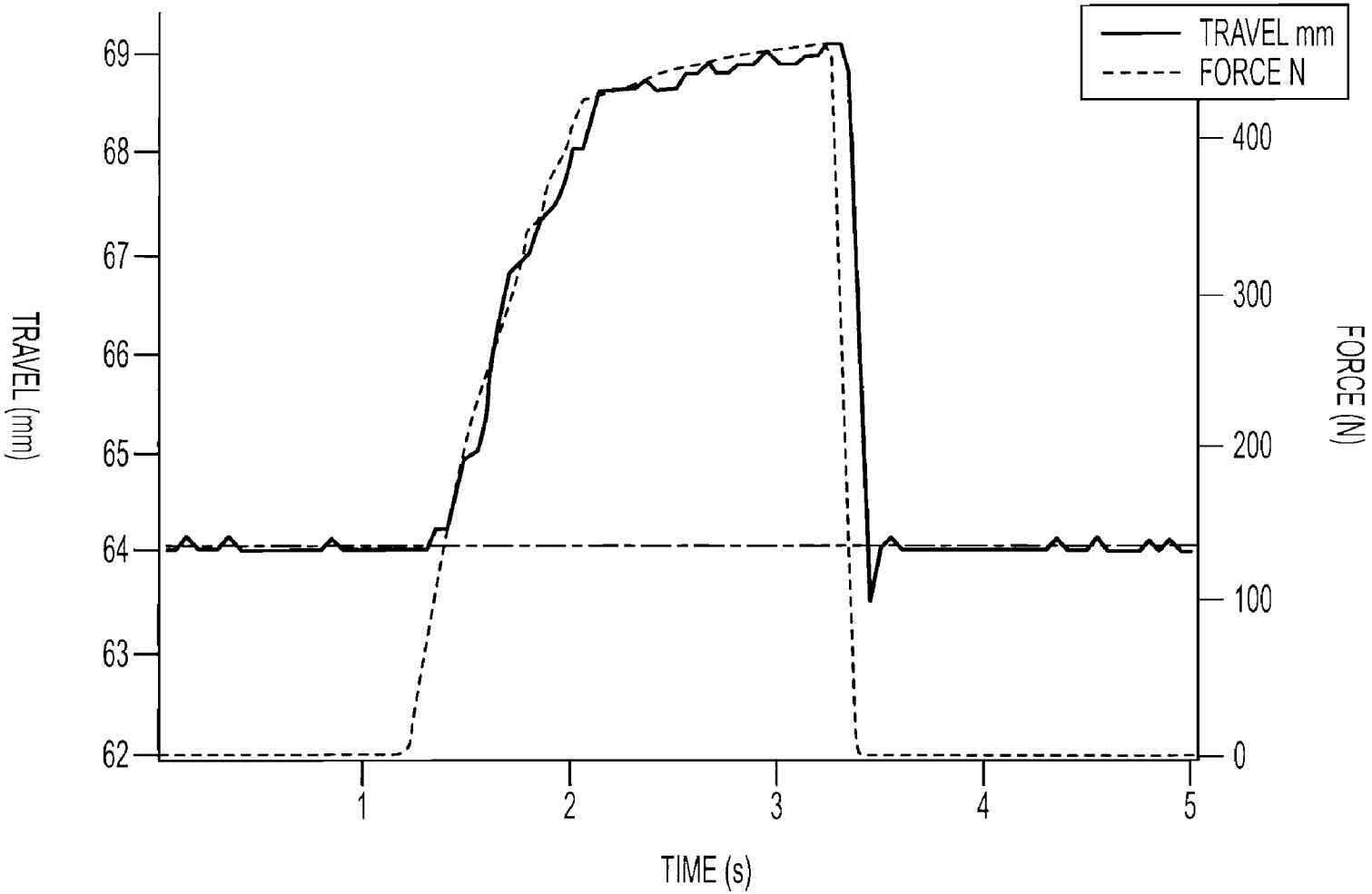

According to the graphical illustration shown in FIG. 4, at the commencement of deflection the rise of the travel curve takes place with a time delay in relation to the rise of the force curve. This points to the fact that the knocking ram and/or the heat exchanger element are/is subject to high friction. It is conceivable, for example, that the heat exchanger element is jammed in the wall guide. Moreover, the fall of the travel curve takes place with a time delay in relation to the fall of the force curve after the relief of the lifting cylinder, thus supporting the above interpretation.

Figure 5:
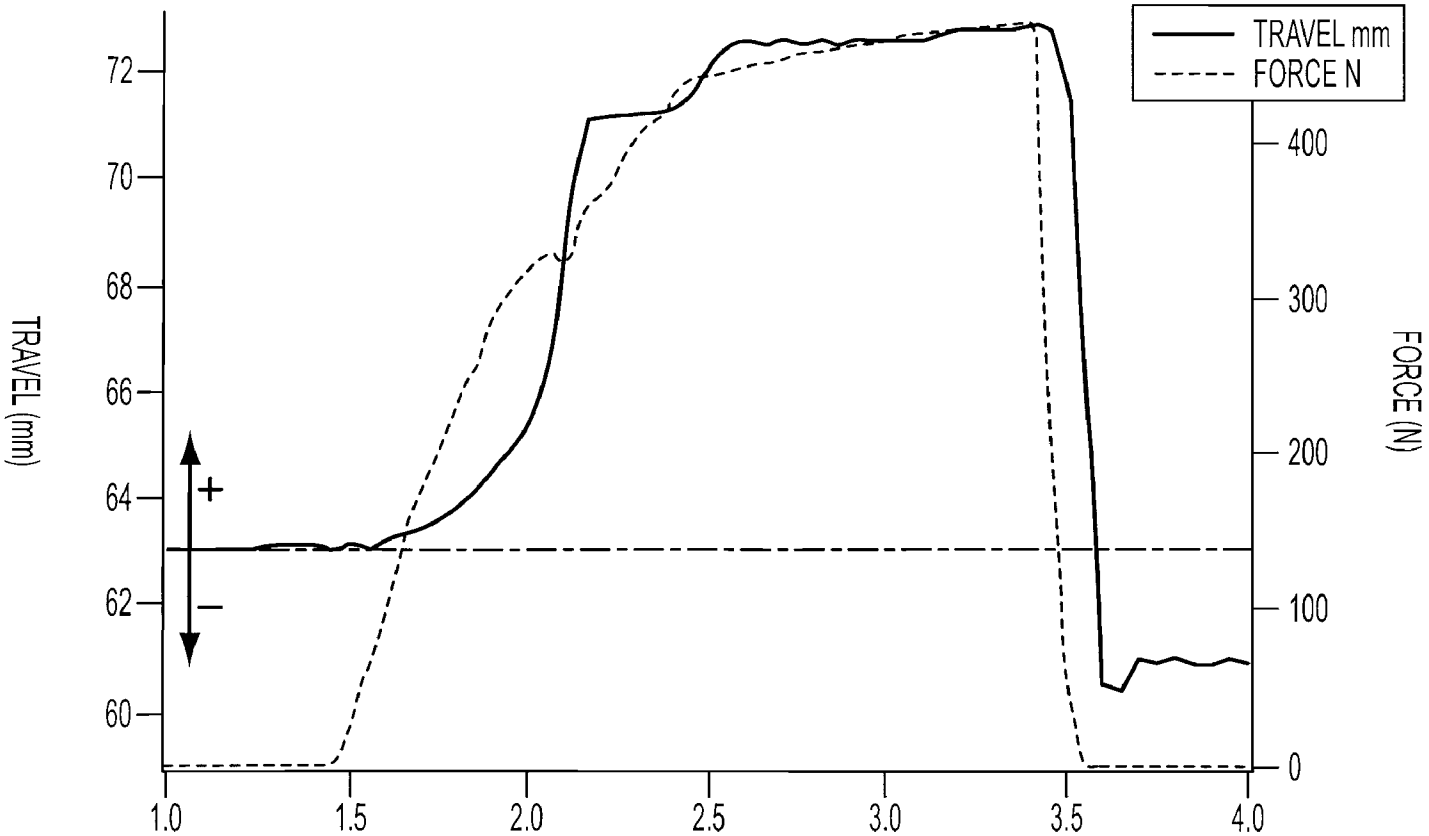

According to the illustration shown in FIG. 5, the rise of the travel curve takes place with a pronounced time delay in relation to the rise of the force curve, thus, again, pointing to the fact that the knocking ram and/or the heat exchanger element are/is subjected to high friction. With an essentially linear increase in the force, the travel curve increases virtually exponentially, thus making it possible to draw conclusions as to a friction-induced prestressing of the knocking ram or of the heat exchanger element at the start of the stroke. It is conceivable, for example, that the heat exchanger element is initially blocked and suddenly becomes free in the case of a specific force. As in FIG. 4, in FIG. 5 the fall of the travel curve also takes place with a time delay in relation to the fall of the force curve after the relief of the lifting cylinder. Moreover, during the backswing, the oscillation of the heat exchanger element is attenuated beyond its initial position, which could point to a jamming of the heat exchanger element at the start of the test time.

Figure 6:
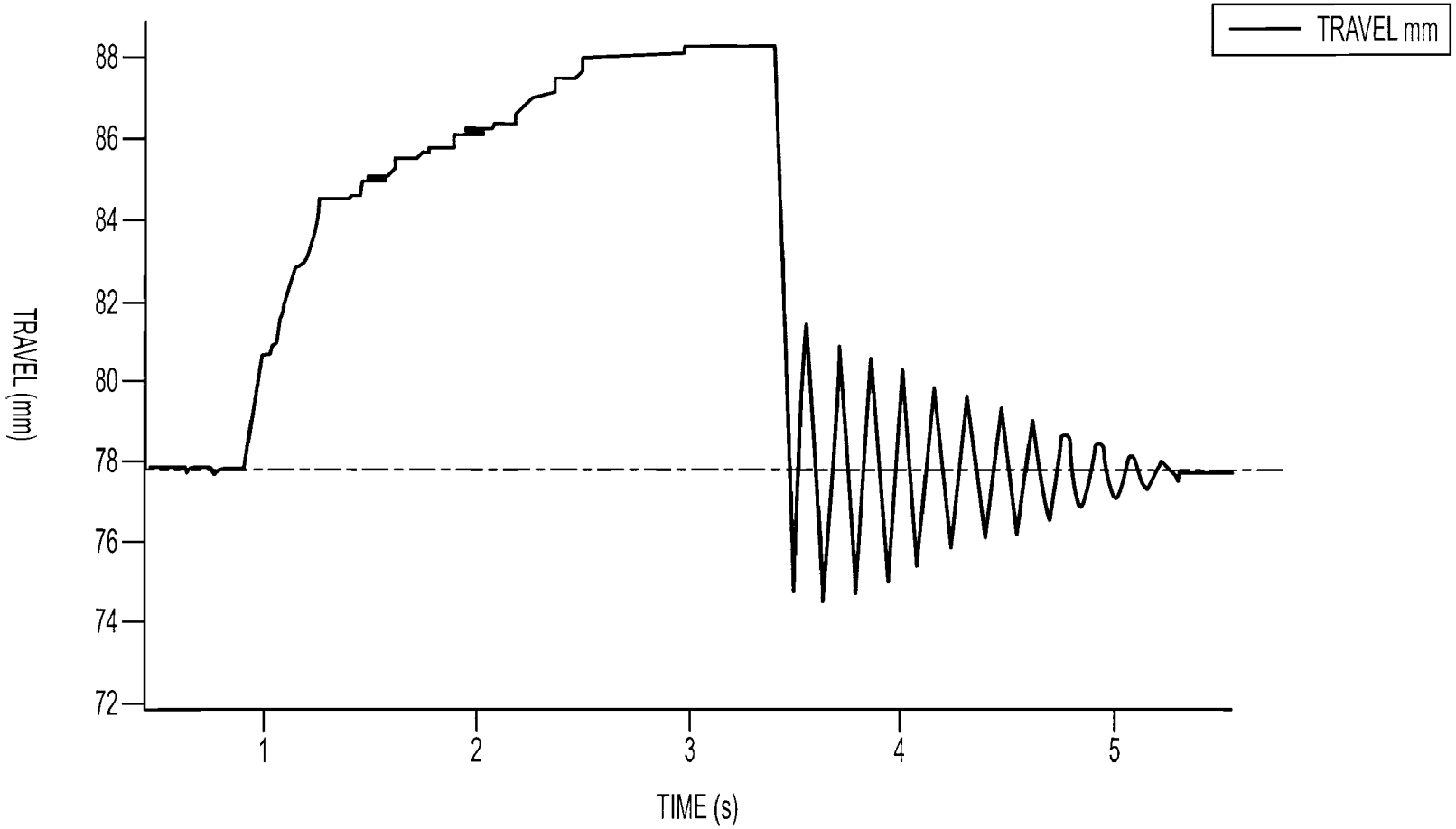

In FIG. 6, only the attenuation behavior, determined according to the invention, of the heat exchanger element is reproduced for a further situation. According to FIG. 6, the first three wave troughs of the oscillation curve lie essentially at the same depth, while the wave tips decrease according to a damped oscillation. This points to the fact that the heat exchanger element is arranged nearer to the wall through which the knocking ram passes than the wall lying opposite this and butts against the former during attenuation.

Figure 7:
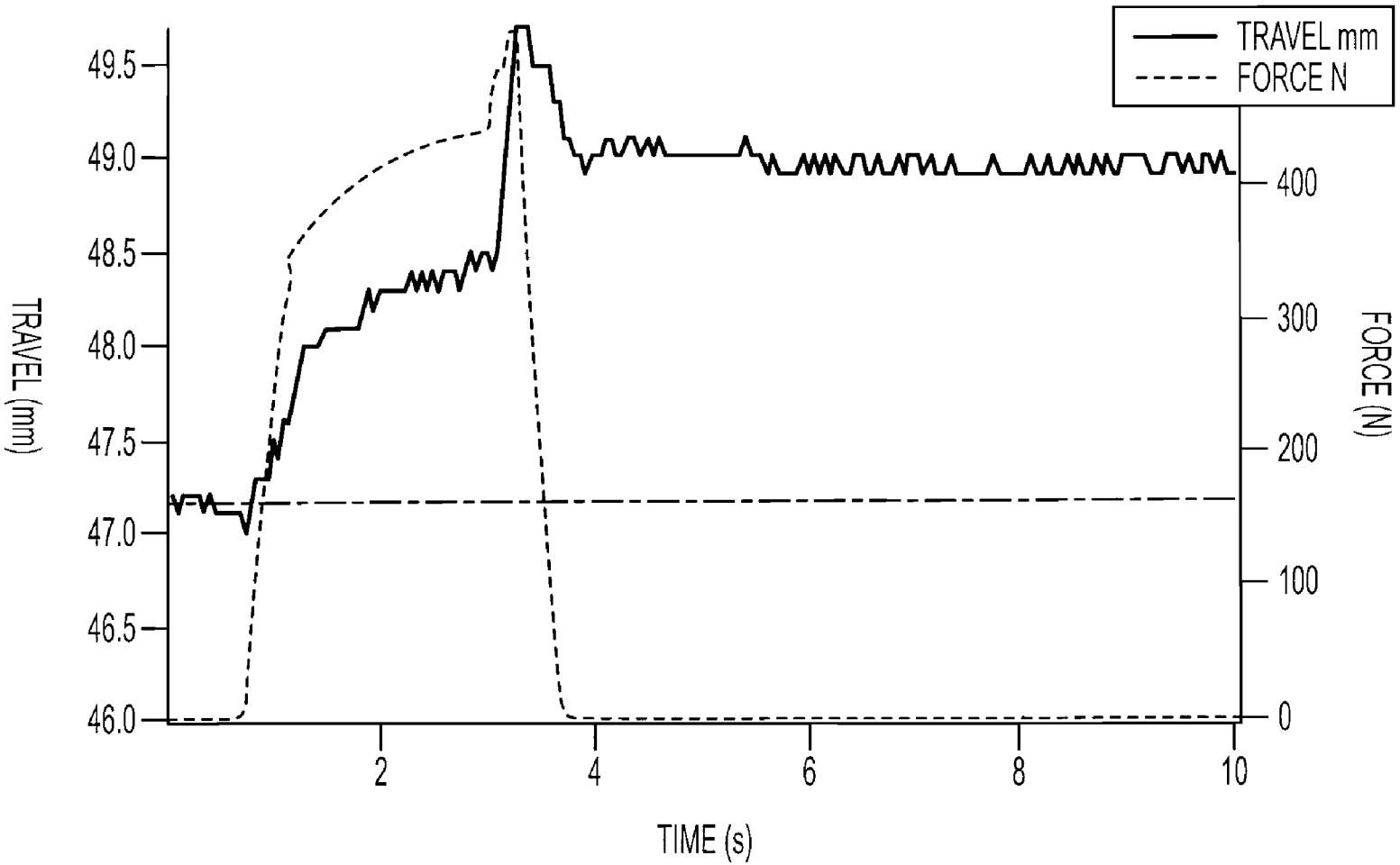

According to FIG. 7, at the commencement of deflection, the increase of the force curve and that of the travel curve take place essentially simultaneously. After the relief of the lifting cylinder, the fall of the travel curve takes place with a time delay in relation to the fall of the force curve. Moreover, the heat exchanger element no longer reaches the position of rest after relief. This may be explained, for example, in that the heat exchanger element is jammed during deflection.

Figure 8:
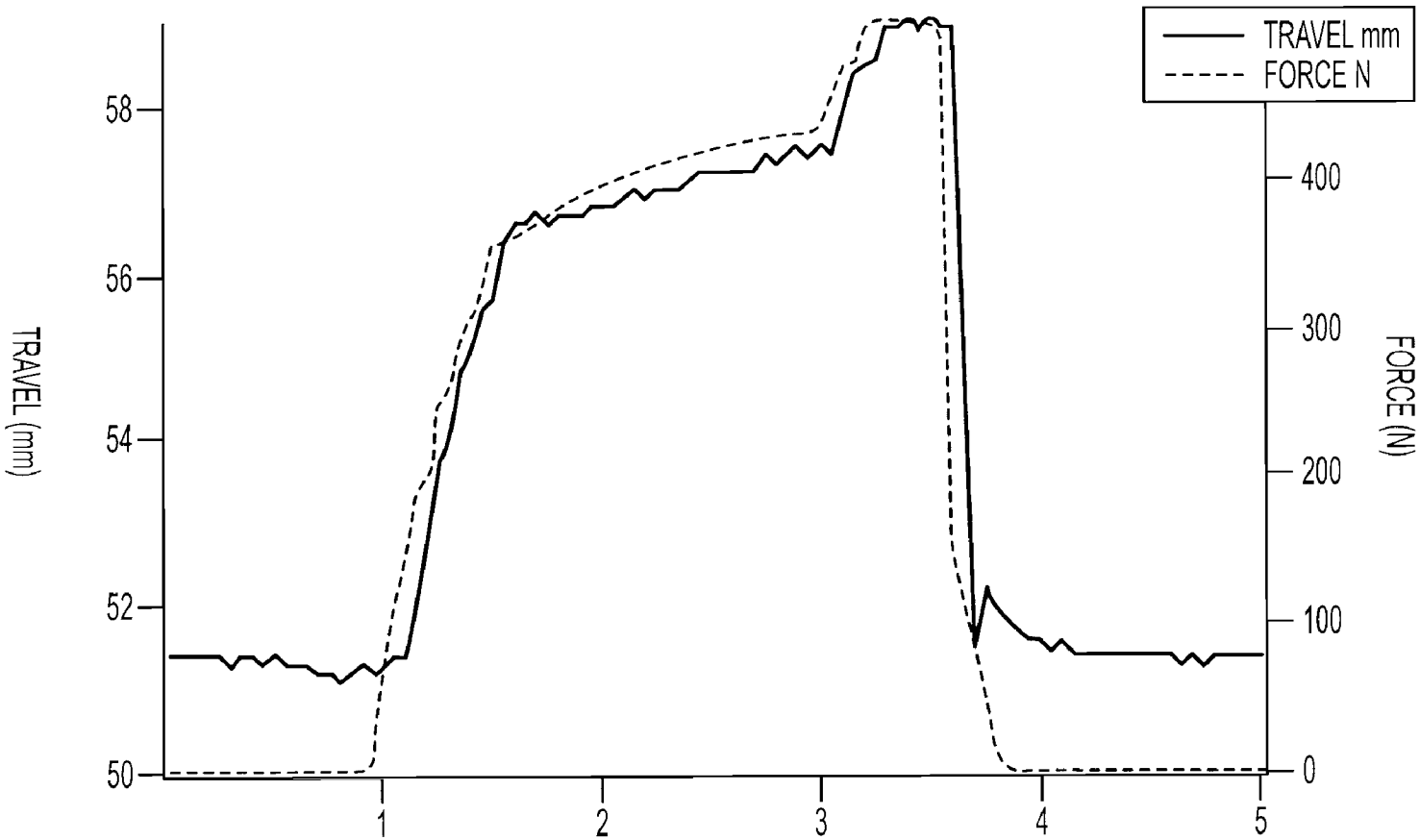

According to FIG. 8, as, for example, also according to FIG. 4 or 5, the rise of the travel curve takes place with a pronounced time delay in relation to the rise of the force curve. This again points to the fact that the knocking ram and/or the heat exchanger element are/is subjected to high friction.

The invention claimed is:

1. A method for checking a knocking device which is intended for cleaning the surface of a heat exchanger element arranged on the inside of a boiler housing of a garbage incineration plant and which has a knocking ram guided through the wall of the boiler housing and movable in the direction toward the inside, the heat exchanger element being deflected out of its position of rest into a deflection position by means of the knocking ram, and at least one of A) the force required for deflecting the heat exchanger element and B) the attenuation behavior of the heat exchanger element released after deflection being determined.

2. The method as claimed in claim 1, both the force required for deflecting the heat exchanger element, according to A), and the attenuation behavior of the heat exchanger element, according to B), being determined.

3. The method as claimed in claim 1, the force required for deflecting the heat exchanger element being determined by means of a force sensor.

4. The method as claimed in claim 1, the movement of the knocking ram being detected in order to determine the attenuation behavior of the heat exchanger element.

5. The method as claimed in claim 4, the knocking ram being held in bearing contact against the heat exchanger element, in particular by means of a spring.

6. The method as claimed in claim 1, the attenuation behavior of the heat exchanger element being determined by means of a travel sensor.

7. A device for carrying out the method as claimed in claim 1, with a drive for moving the knocking ram in the direction toward the inside of the boiler housing, defined by at least one of a) a force sensor for determining the force required for deflecting the heat exchanger element and b) means for releasing the heat exchanger element when the deflection position is reached and a travel sensor for determining the attenuation behavior of the released heat exchanger element.

8. The device as claimed in claim 7, defined by means for holding the knocking ram in bearing contact against the heat exchanger element.

9. The device as claimed in claim 8, wherein the means for holding comprises a spring.

10. The device as claimed in claim 7, wherein the travel sensor has an optical distance sensor, preferably a laser rangefinder.

11. The device as claimed in claim 7, wherein one of the force sensor or the travel sensor is assigned a data recorder.

* * * * *